United States Patent [19]

Jones et al.

[11] 4,412,826

[45] Nov. 1, 1983

[54] SAFETY SHIFT DEVICE FOR OUTBOARD MOTORS

[76] Inventors: William A. Jones, 70 East Ave., Marion, Mass. 02738; Hugh M. Young, 98 Swanson Ter., Stoughton, Mass. 02072

[21] Appl. No.: 299,992

[22] Filed: Sep. 8, 1981

[51] Int. Cl.[3] ..... B63H 5/13

[52] U.S. Cl. ..... 440/86; 74/501 R

[58] Field of Search ..... 440/75, 84, 85–87, 440/63, 6; 114/144 R, 144 B, 144 C; 74/469, 473 R, 473 P, 477, 478.5, 480 B, 501, 504

[56] References Cited

U.S. PATENT DOCUMENTS

| | | | |
|---|---|---|---|
| 2,365,490 | 12/1944 | Pieron | 74/480 B |
| 2,915,915 | 12/1959 | McKay | 74/480 B |
| 3,073,278 | 1/1963 | Brewster | 440/86 |
| 3,503,360 | 3/1970 | Hoff | 440/86 |

*Primary Examiner*—Trygve M. Blix
*Assistant Examiner*—Jesus D. Sotelo
*Attorney, Agent, or Firm*—Robert T. Gammons

[57] ABSTRACT

A device for attachment to the gear shift lever of an outboard motor to enable shifting the gears from neutral to forward and/or reverse at a safe distance inboard of the motor.

1 Claim, 4 Drawing Figures

SAFETY SHIFT DEVICE FOR OUTBOARD MOTORS

BACKGROUND OF INVENTION

Outboard motors are used extensively by fishermen both for commercial and sport purposes, by hunters, by water skiers and for general uses such as sightseeing and transportation to and from moorings for large boats. Outboard motors are often used for auxiliary power on small sailboats up to 26' (twenty-six) feet in length and occasionally on larger sailing vessels. In most cases, the gear shift lever and associated parts on the conventional outboard motor are located at the port side near the back and lower casing of the outboard motor housing. In this position, the operator has to reach rearwardly often beyond the stern of the boat in order to grasp the gear shift lever for the purpose of shifting gears and, in this awkward, unbalanced position, there is considerable danger, particularly when the water is rough, of losing one's balance or control of the motor. Numerous devices have been patented to enable the operator to control the motor without having to lean backwardly or to be at the stern of the boat. Such devices are shown, for example, in the following U.S. Pat. Nos.

2,635,576—Kiekhaefer
2,703,989—Schroeder
2,278,320—Kloss
2,743,624—Schroeder
2,887,083—Conroy
2,915,915—McKay
3,073,278—Brewster
3,121,415—Anderson et al.
3,145,688—Kincannon
3,503,360—Hoff
3,613,636—Farrell
4,228,760—Kulischenko All of the aforesaid devices are rather complex, made up of several parts, are costly and troublesome to attach. It is the purpose of this invention to provide a relatively simple device for effecting shifting which will not embody the disadvantages of the structure shown in the aforesaid patents.

SUMMARY OF INVENTION

As herein illustrated, the device for actuating the gear shift lever comprises an elongate rod and means for securing one end of the rod to the gear shift lever so that in the neutral position of the gear shift lever, the rod is in a substantially horizontal position extending forwardly from the gear shift lever in an inboard direction beyond the inboard end of the motor housing, said means comprising an extension at right angles to the proximal end of the rod and means for fastening the extension to the gear shift lever in parallel relation thereto, said rod being operable by depression in a plane perpendicular to the axis about which the gear shift lever is pivoted to engage the gears for forward movement and by elevation in said plane to engage the gears for reverse. The extension is an integral part of one end of the rod bent at right angles thereto and there is a knob at the other end which may be grasped to manipulate the rod. The gear shift lever contains a hole, the axis of which is spaced from and parallel to the axis of rotation thereof and there is a hinge pin fixed to the extension and at right angles to the plane of the extension and rod engaged within the hole in the gear shift lever. A band clamp is secured to the extension above the hinge pin in embracing relation to the gear shift lever comprising a circular member fastened to the extension in a position such as to engage the gear shift lever.

The invention will now be described in greater detail with reference to the accompanying drawings, wherein.

Figure 1:
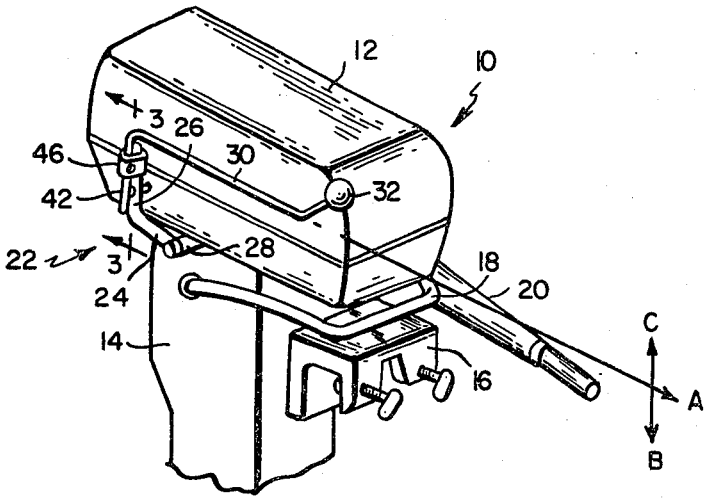
FIG. 1 is a perspective view of the upper part of a typical outboard motor.
Figure 3:
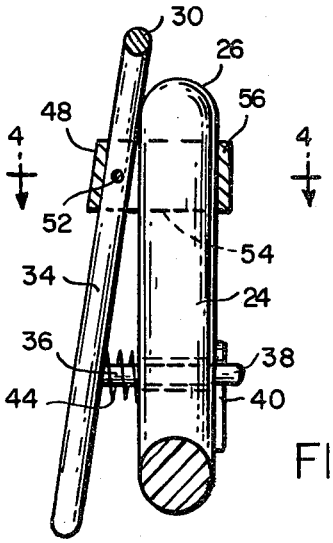
FIG. 3 is an enlarged fragmentary elevation taken on the line 3—3 of FIG. 1.

Referring to the drawings, FIG. 1, there is shown the upper part 10 of a conventional outboard motor comprising a housing 12 from the lower side of which extends downwardly the housing 14 for the drive shaft and a bracket 16 for attaching the outboard motor to the transom of a boat. There is a carrying handle 18 at the inboard side of the motor, a tiller 20 at the right side which extends in an inboard direction and a gear shift lever 22 at the left side. The gear shift lever 22 is of angular configuration comprising a substantially horizontal arm 24 and a substantially vertical arm 26. The arm 24 is connected to a horizontal shaft 28 so that the gear shift lever 22 is rotatable in a vertical plane about a horizontal axis. Rotation of the gear shift lever 22 in a clockwise direction about the axis of the shaft 28 will shift the gears into forward drive and rotation in a counterclockwise direction will shift the gears into reverse drive.

Figure 4:
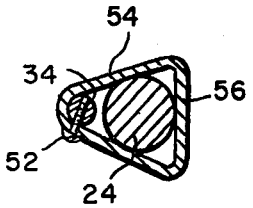
FIG. 4 is a section taken on the line 4—4 of FIG. 3.
Figure 2:
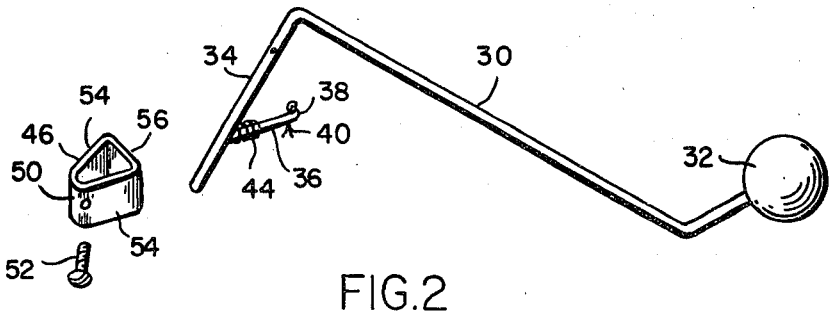
FIG. 2 is a perspective of the device for actuating the gear shift lever of the outboard motor according to this invention.

As has been pointed out previously, the position of the gear shift lever 22 is awkward for the person operating the motor, requiring that the person lean over the motor itself and lean toward the stern of the boat to effect the shifting in rough water and/or when there are other persons or gear in the boat, the operator can very easily be maneuvered into a position to lose his balance and hence, lose control of the motor and possibly be thrown overboard. It is the purpose of this invention to provide a device which will enable shifting the gear shift lever without having to lean across the motor and/or rearwardly over the transom. As illustrated, the device comprises, FIGS. 1 and 2, a rod 30 secured at its proximal end to the arm 26 of the gear shift lever 22 in such a way that, in the neutral position, the rod is parallel to the motor housing, substantially horizontal, and extends forwardly, that is, in an inboard direction from the transom toward the inboard end of the motor and at its distal end a knob 32 which may be grasped to effect its manipulation. For securing the rod to the arm 26, the rod is provided at its proximal end with a right angular extension 34. Approximately midway of the length of the extension 34, there is fixed a hinge pin 36 at right angles to the plane defined by the rod 30 and the extension 34. The distal end of the hinge pin 36 contains a hole 38 for receiving a cotter pin 40. The arm 26 contains a horizontally-positioned slot 42 of such size as to receive the hinge pin 36 and the rod 30 is mounted to the handle by inserting the hinge pin through the slot 42 and inserting the cotter pin 40 in the distal end of the hinge pin. A coil spring 44 is positioned on the hinge pin 36 between the extension 44 and the arm 26 under compression. In order to prevent the rod from turning relative to the arm 26 about the axis of the hinge pin, there is provided a band clamp 46 which is fastened to the extension 44 about the axis of the hinge pin 36 so as to embrace the portion of the arm 26 above the hinge pin. As illustrated, the band clamp contains a hole 50 for receiving a screw 52 by means of which it is fastened to the extension 44. As shown in FIG. 4, when the band clamp is applied, the extension is held clamped in parallel relation to the arm 26.

When the device is installed, the rod 30 occupies a substantially horizontal position in the neutral position of the gears as shown by the arrow A. In order to engage the gears for forward motion, the rod is depressed as indicated by the arrow B and then the gears are to be shifted to reverse, the rod is elevated as indicated by the arrow C. The device thus constitutes a very simple safety shift for an outboard motor. The actual length of the rod may be varied to achieve the most satisfactory inboard position for effecting the gear shifting. Desirably, the distal end should project inboard beyond the inboard end of the motor housing.

The rod and extension are comprised of stainless steel of approximately $\frac{1}{4}$ inch in diameter. The band clamp and set screw are also of stainless steel and the knob is plastic and approximately $1\frac{1}{2}$ inches in diameter. It is to be understood, however, that other materials than stainless steel may be used for the parts and that the diameters and lengths referred to are not restrictive.

It should be understood that the present disclosure is for the purpose of illustration only and includes all modifications or improvements which fall within the scope of the appended claims.

What is claimed is:

1. A device for actuating the gear shift lever of an outboard motor rotatable about the horizontal axis of a shfat extending laterally from the motor, wherein said gear shift lever has an upstanding vertical arm offset rearwardly of and extending upwardly from the axis of the shaft, comprising an elongate control rod provided at one end with an integral right angular downward extension and its other end with a knob, means for securing said downward extension to the upstanding vertical arm of the gear shift lever in parallel relation thereto so that, in the neutral position of the gear shift lever, the control rod is substantially horizontal and the end provided with a knob extends forwardly from the gear shift lever in an inboard direction beyond the motor and means for fastening said extension to said arm, comprising a pivot pin fixed at one end to the lower end of the extension, a hole in the lower end of the arm through which the pivot pin extends from the outer side through the hole to the inner side, a coil compression spring positioned about the pivot pin between the extension and the arm, a cotter pin fixed to the pivot pin at the inner side of the arm, a collar positioned about the extension and the arm adjacent the upper end of the arm and a set screw fixing the collar to the extension.

* * * * *

UNITED STATES PATENT AND TRADEMARK OFFICE

CERTIFICATE OF CORRECTION

PATENT NO. : 4,412,826

DATED : November 1, 1983

INVENTOR(S) : William A. Jones

It is certified that error appears in the above-identified patent and that said Letters Patent are hereby corrected as shown below:

column 4, line 6, "shfat" should read --shaft--

Signed and Sealed this

*Third* Day of *January 1984*

[SEAL]

*Attest:*

GERALD J. MOSSINGHOFF

*Attesting Officer*

*Commissioner of Patents and Trademarks*